United States Patent [19]

van der Lugt

[11] 4,296,769

[45] Oct. 27, 1981

[54] CLOSURE TREATMENT MACHINE

[75] Inventor: Arie van der Lugt, Krimpen an der Isssel, Netherlands

[73] Assignee: Gist-Brocades N.V., Delft, Netherlands

[21] Appl. No.: 131,911

[22] Filed: Mar. 20, 1980

[30] Foreign Application Priority Data

Mar. 21, 1979 [NL] Netherlands ..... 7902218

[51] Int. Cl.³ ..... B08B 3/02

[52] U.S. Cl. ..... 134/68; 134/72; 134/126; 134/151; 134/199; 118/316; 118/500

[58] Field of Search ..... 134/68, 72, 82, 124–128, 134/131, 151, 199–201; 118/316, 500

[56] References Cited

U.S. PATENT DOCUMENTS

| | | | |
|---|---|---|---|
| 2,358,507 | 9/1944 | Haberstump | 134/72 |
| 3,056,414 | 10/1962 | Nolte | 134/72 X |
| 3,565,239 | 2/1971 | Walker et al. | 134/72 X |
| 4,074,651 | 2/1978 | Noguchi et al. | 118/73 |

FOREIGN PATENT DOCUMENTS

| | | | |
|---|---|---|---|
| 1078012 | 3/1960 | Fed. Rep. of Germany | 118/500 |
| 1073051 | 3/1954 | France . | |
| 2245541 | 4/1975 | France . | |

*Primary Examiner*—Robert L. Bleutge

*Attorney, Agent, or Firm*—Fleit & Jacobson

[57] ABSTRACT

A closure treatment machine having one or more caskets (1) for holding the closures (9); said caskets comprise a number of parallel bars (2, 3, 4), which are connected at both ends to each other by coupling plates (5, 6), whereby the parallel bars are arranged in such a way that the closures are held between said bars but still do have such a tolerance, that the cleansing liquid sprayed from nozzles (23) towards the closures may reach any side of the closures. For filling and emptying the caskets at least one of the coupling plates has an opening (7, 8) for passing the closures. The caskets which are moved by means of chains (16) may be led after a cleansing station to a drying station or a sterilization station.

13 Claims, 12 Drawing Figures

CLOSURE TREATMENT MACHINE

The present invention generally relates to a closure treatment machine and more particularly to a treatment machine for treating head-shaped closures, especially rubber closures, fit for vials for containment of a medical injection solution, provided with at least a means, holding the closures during the cleansing stage and provided with nozzles which have such positions, that the cleansing liquid can be sprayed towards the closures under different angles.

In a similar known machine a means is present, which is able to hold just one closure, which closure is held against said means under suction with the help of vacuum. The closure held under suction is then cleansed. The advantage of this known machine with respect to earlier known machines, wherein the closures were mass cleansed and for a good cleansing treatment were tumbled together is that the closures after the treatment do not contain miniscule particles of rubber, which are produced on account of the tumbling together and the frictional engagement of the closures present in the earlier known machines. These miniscule particles may represent a danger. If the closures are used for vials with for instance infusion or injection liquids these miniscule particles may come into the infusion or the injection liquid. When the infusion or injection liquid is brought in the blood stream of the patient also these particles will come in the vains and may block up the cappillaries of the patient. Particles having a diameter of more than about 2 microns may represent this danger.

Although in the known machine the problem of the production of undesired particles may be avoided, it is clear that the known machine operates very inefficiently because at a time just one closure is exposed to the treatment. Moreover on account of the vacuum transport in the known cleansing machine no spraying liquid under high pressure can be used because in that case it is possible that the closure will be sprayed away. Further the known machine has the objection, that not all sides of the closures can be cleansed in one step. The side of the closure, which is held by the vacuum is out of reach for the cleansing liquid unless a mechanism is introduced, which picks over the closure by means of a second vacuum means, so that the other side of the closure can be cleansed. Consequently this means is introduced in the known machine.

The object of the invention is to avoid above objections and still have the advantage that closures without miniscule particles are obtained.

The invention provides a machine fulfilling above conditions and having other advantages, which will be clear from the undermentioned.

Accordingly the present invention provides a machine for the treatment of head-shaped closures, especially rubber closures, fit for vials for infusion or injection liquids, comprising at least a means for holding said closures during the cleansing stage, and nozzles which have such positions, that the cleansing liquid can be sprayed under several angles towards the closures, characterized in that the means for holding the closures comprises one or more caskets, having each a few, preferably three parallel bars, which are connected to each other at both ends with coupling plates, whereby the parallel bars are arranged in such a way, that the closures may find their place there between in the form of a row of a preliminary fixed number and held in such a way, that the closures cannot be moved out of the space between the bars during the cleansing stage but do have such a tolerance, that the cleansing liquid can reach any side of the closures whereby at least one of the coupling plates has at least an opening for passing the closures and the other coupling plate forms an eventual temporary barrier for the closures, whereas a carryig means may lead the caskets filled with closures along the nozzles spraying the cleansing liquid Because of the fact that the machine according to the present invention has the possibility to cleanse a great amount of closures in one time under avoiding of the fact, that the closures during the cleansing stage are brought into frictional engagement, it is achieved that said machine can operate economically, as well as closures without miniscule particles are obtained. Since the closures in the machine according to the present invention are locked up between the bars during the cleansing stage the cleansing liquid can be sprayed under high pressure towards the closures without the danger that the closures will be sprayed away. For that reason the closures can be cleansed more intensively. Because of the fact, that the closures are brought into the caskets it is also achieved, that the closures are cleansed in one step without the necessity of transferring the closures as in the known machine. Moreover the machine according to the present invention creates the possibility of avoiding the intervention of physical labour between the closure cleansing step and the capping step so that possible infections can be avoided completely.

The machine according to the present invention comprises one or preferably two carrying chains as carrying means, which are provided with a number of links on regular distances which may carry one of the coupling plates. With two chains moving synchronous the caskets may be carried away in horizontal condition by means of each of the coupling plates present at the ends of the caskets. In this way the caskets filled with closures may be led through the cleansing stage comprising nozzles for spraying the cleansing liquid. The caskets filled with closures may also pass other stations, whereas they are led further by means of the chains. Another station is for instance a drying station whereas the caskets may also be led through a sterilisation station. This last step has the advantage over usual sterilisation machines that the closures do not stick together in the sterilisation stage so said closures do not need to be separated by hand.

The links of the carrying chains which can carry away the caskets are preferably provided with a tray, wherein a coupling plate of the caskets fits. The caskets may then easily be lifted off from the chain. Preferably each of the chains is led through a channellike rail provided with such a groove that one row of links move through the rail and the other row of links moves outside the rail. Therefore the innerside of the rail is preferably filled up with asynthetic material having a low friction resistance with respect to the chain whereby a groove is present in the synthetic material having such profile, that the chain may be pushed there along and also will held in position. Examples of suitable synthetic materials are polyethylene and nylon. This construction has the advantage that the chains hardly need any maintenance.

The links of the carrying chain can also be provided with pins whereas the caskets are supported by a leading strip of synthetic material. The two chains may if they move synchronous transport the caskets over the leading strips.

For the filling of the caskets with closures and the removal thereout preferably an intermittent moving vertical star-shaped disk is present between the carrying chains which in cooperation with the leading grooves for the coupling plates may lift off the caskets from the trays fixed to the chains and to bring them in vertical position so that the caskets may take up or release closures. For the take up of the closures the casket is brought under a slide of a sorting machine for closures, over which correct oriented closures can be brought into the casket. A sorting machine for closures suitable for the above aim is the machine according to German patent specification No. 2,342,652.

For bringing the caskets into a vertical position they preferably have a support in the middle provided with an opening, so that the closures may pass therethrough. The vertical star-shaped disk is preferably provided with a fork on each of this ends which may grasp said support of the casket and lift off the casket from the chains whereafter the coupling plates of the casket get in leading grooves which bring the casket by further rotating of the star-shaped disk in a vertical position.

If carrying pins are used preferably a means is present with which the casket can be brought in vertical position between said pins. At the place of said means the carrying profile of the leading strips is interrupted.

For the release of the closures the star-shaped disk-having the casket in vertical position-cooperates preferably with a horizontal disk (nest disk) which is provided along the periphery with recesses wherein the coupling plates of the caskets fit which disk may transfer the caskets on a transport strip, which passes under the nest disk for which the caskets are provided at the then upper coupling plate with a cam with which the caskets can be held by the transport strip which transport strip brings the caskets to a second nest disk which brings the caskets to a station for the release of the closures. In said station a means is present which can pull away a closing pin or spring present at the then lower coupling plate of the caskets, so that the closures may leave the caskets and may lead to a capping machine for closures, whereafter the second nest disk puts the casket again on the transport strip in order to be transferred to the first nest disk which puts the casket back on the vertical star-shaped disk, which puts the casket again on the carrying chain. With this construction it is possible to bring the closures after the cleansing stage and possible further treatments to a capping machine without the intervention of physical labour with the possibility of infections.

The machine according to the present invention offers a lot of possibilities. It is for instance possible to treat closures of several dimensions with a machine of the present invention. Therefore it is only necessary to adapt the caskets. It is clear that the machine according to the present invention is also suitable for closures which do not consist of rubber for instance closures of synthetic material.

In any event these and other objects and features of the present invention will become apparent from the following description taken in conjunction with preferred embodiments thereof with reference to the accompanying drawings in which FIG. 1 is a perspective view of a casket which is usable in the machine according to the present invention;

Figure 1:
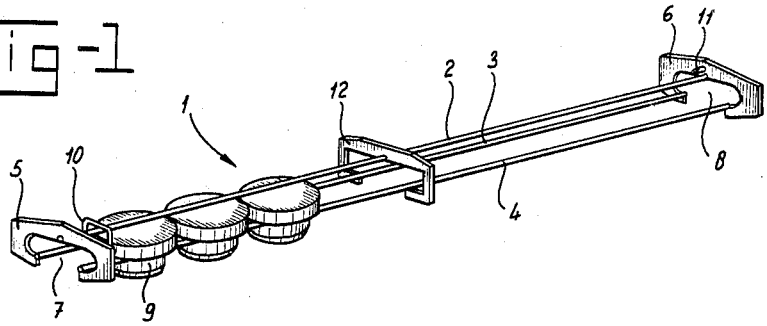

FIG. 1 shows a casket which may be used in the machine according to the present invention. Said casket 1 has three parallel bars 2, 3 and 4, which are fixed on the ends thereof to two coupling plates 5 and 6. On both coupling plates the casket is provided with an opening 7, 8 wherethrough the closures 9 may pass. For achieving that the closures cannot pass the coupling plate 5 a spring 10 is mounted on plate 5 which spring may be pulled side-wards. The closures may find a place between the bars 2–4 whereby the edge of the closures remains under bars 2 and 4 which do have such distance from each other that the part of the closure which will be brought into the vials fits therebetween. In other embodiments the coupling plate 5 is closed completely so that spring 10 becomes superfluous. In that case of course the filling and the release of the caskets have to take place through the coupling plate 6.

The coupling plate 6 is further provided with a cam 11 which meaning will be clear from the following description.

With long caskets it may be beneficial to use at regular distances oen or more stiffening plates which have the same shape as coupling plate 6. A stiffening plate 12 in the middle of the caskets has several functions yet given below.

FIGS. 2 to 5 show how the caskets are transported. The coupling plates 5 and 6 of the caskets 1 lie in trays 15 which are fixed to chain 16. Therefore a link of chain 16 is provided with a bended lip 17 whereon tray 15 is mounted with bolts and nuts 18. (Tray 15 is drawn in FIG. 5 in cross section along V in FIG. 4). So the caskets do lie loose in the trays 15.

The chains 16 are locked up in rails 20, comprising a metal profile 21 wherein a groove is left so that one row of links of the chain can move outside the rails. The rails 20 are filled up with a synthetic material 22 wherein, however, a profiled groove is present and with such a shape, that the chain may glide there along but will held also in position.

The rails may move horizontal but may also move upwards and downwards for if necessary bringing the caskets on another level. Both chains do move synchronous and return with the caskets. The stiffening plate 12 in the middle of the caskets is led thereby along a strip of preferably synthetic material for keeping the caskets at their place during the return of the chains.

Figure 2:
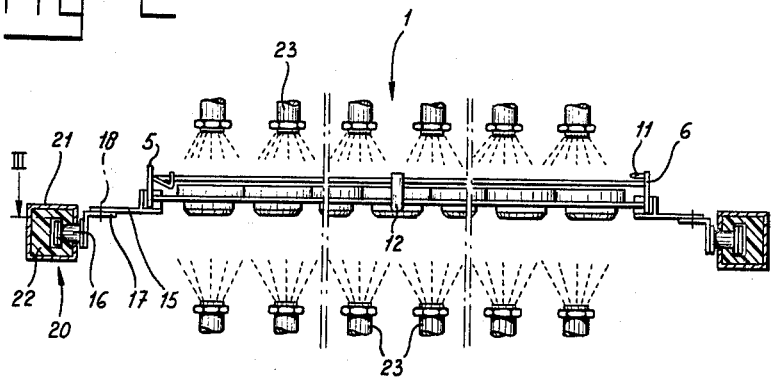
FIG. 2 is a side view of the casket according to FIG. 1 laid on the trays fixed to the carrying chains led by a rail filled up with a synthetic material.
Figure 3:
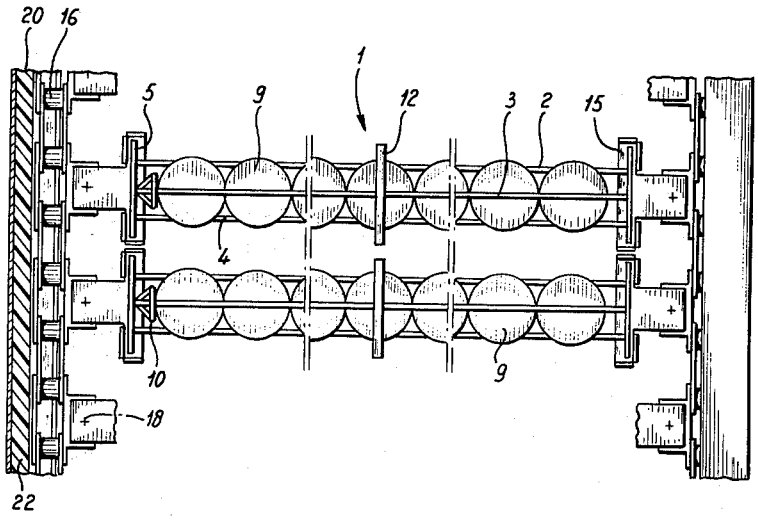
FIG. 3 is an upper view of the machine as present in FIG. 2 whereby one of the rails is drawn in cross section taken along III in FIG. 2.
Figure 4:
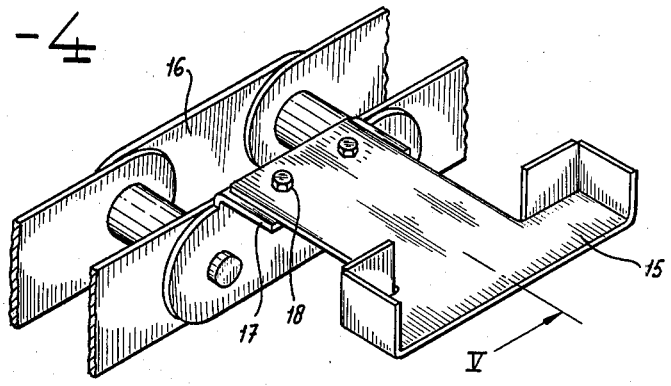
FIG. 4 is a perspective view of a tray wherein one of the coupling plates of a casket may rest upon; said tray is fixed to a link of one of the carrying chains.

In FIG. 2 nozzles 23 are drawn which are placed in the cleansing room. The closures will be cleansed on all sides by spraying cleansing liquid thereupon. After passing the cleansing stage other stations may be passed whereas the closures and the caskets are transported by means of the chains. For instance it is possible to pass a drying station.

Figure 5:
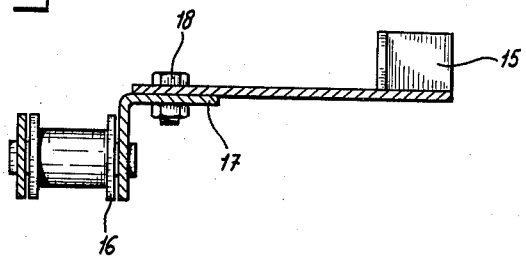
FIG. 5 is a side view of the tray according to FIG. 4 partly drawn in cross section along V in FIG. 4.
Figure 6:
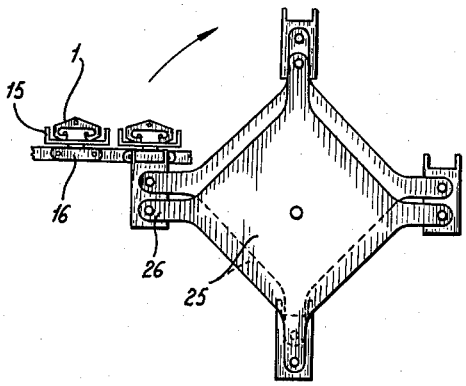
FIG. 6 is a side view of a star-shaped disk for lifting up the caskets from the carrying chains and to bring them in vertical position.
Figure 7:
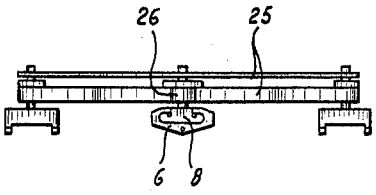
FIG. 7 is an upper view of the star-shaped disk in FIG. 6.
Figure 8:
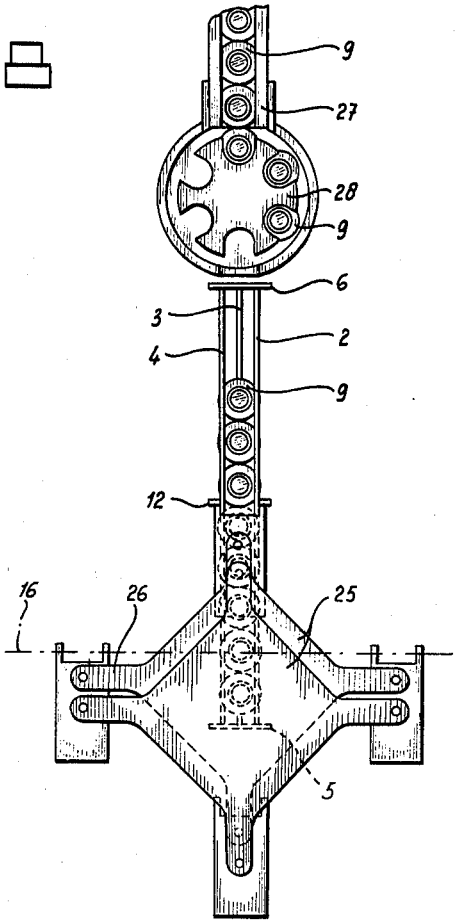
FIG. 8 is a side view of the star-shaped disk in FIG. 7 provided with a casket brought in vertical position under the slide of a sorting machine for closures.
Figure 9:
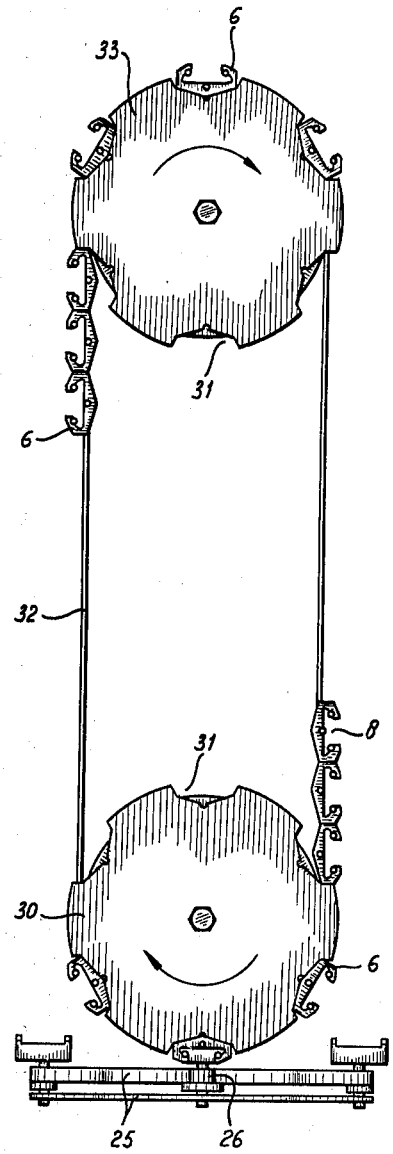
FIG. 9 is an upper view according to FIG. 7 together with a transferring means for transporting the caskets to a station wherein the closures are released.

FIG. 6 shows the way according to which the caskets can be lifted off from the chain haulers 15 of FIG. 5. This in connection with the emptying and filling stage of the caskets. A vertical star-shaped disk present between the chains 16 rotates intermittent but synchronous with chains 16 having a peripherical speed which is greater than that of the chains. An arm 26 of the star-shaped disk 25 lifts off casket 1 at the stiffening plate 12 from a tray of the chain. By further rotating of the star-shaped disk the casket is taken further and is led thereby over guiding gutters (not shown) wherealong the coupling plates of the caskets are led. The star-shaped disk rotates till the casket taken along is brought in vertical position. This is shown in FIG. 7 in an upper view and in FIG. 8 in a side view. FIG. 8 shows also a conveyer trough of a sorting machine wherein closures can be oriented and of which only the end of the conveyor trough 27 is shown. Closures 9 are conveyed therealong and come into one of the recesses of a vertical positioned star wheel 28 for transporting the closures one by one to a position above the casket and follow their way downwards between the bars 2–4 of the casket and accumulate on the coupling plate 5 of the casket.

After some time the star-shaped disk 25 turns further for putting back the casket on the chain hauler 15 whereby also guiding gutters (not shown) are used.

The synchronisation of the star-shaped disk 25 may be carried out for instance by means of a so called Maltheser cross having grooves wherein cams of a continuous rotating wheel rotates the cross everytime over some angle. This Maltheser cross can transfer his movement to disk 25. The continuous rotating wheel containing cams may for instance be moved by the means which also moves chains 16.

For emptying the caskets in principle the same mechanism is used as for the filling. For said emptying, however, use is made of an auxiliary mechanism. When a casket is placed in a vertical position by the star-shaped wheel 25 the casket is taken over by a horizontal rotating nest disk 30 provided with recesses 31 wherein the then upper coupling plates 6 of the caskets fit. The nest disk rotates under carrying the caskets whereby cam 11 moves over a transport strip 32. This transport strip passes partly under nest disk 30 but continues his route further to a second nest disk 33 also containing recesses 31. Because of the cam 11 the caskets stay hanging on the transport strip 32 and follow their way to the second nest disk 33 which takes over the caskets and brings them in a specific position above a release means for the closures. In that position spring 10 of the then lower coupling plate of the casket is pulled aside so that the closures may leave the casket and are led further to for instance a capping machine. After some time spring 10 is released whereupon the casket is carried back in a way analogue to the way by which the casket was supplied. Via transport strip 32 nest disk 30 and the star-shaped disk 25 the casket is put back on the chains 20. During the transport of the caskets along the transport strip 32 the caskets are supported in the middle by leading them along a second strip where the stiffening plates 12 of the caskets may glide along. By that the vertical position of the caskets is realised in a more proper way.

Figure 10:
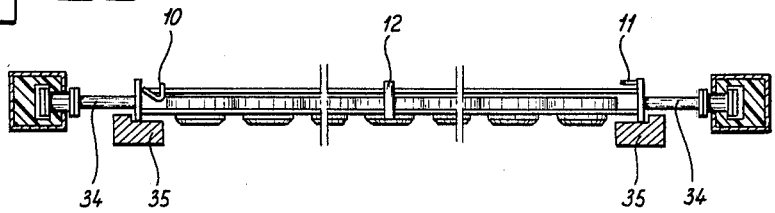
FIG. 10 is a view of a casket provided with carrying pins and present between the two carrying chains on two leading strips of synthetic material.
Figure 11:
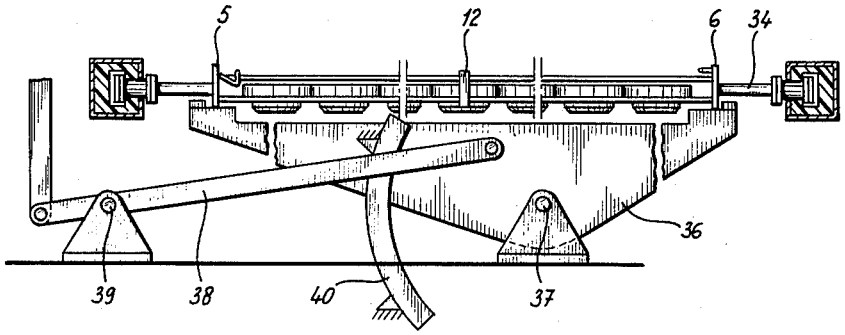
FIG. 11 is a view of a means for bringing the casket as present in FIG. 10 into a vertical position.
Figure 12:
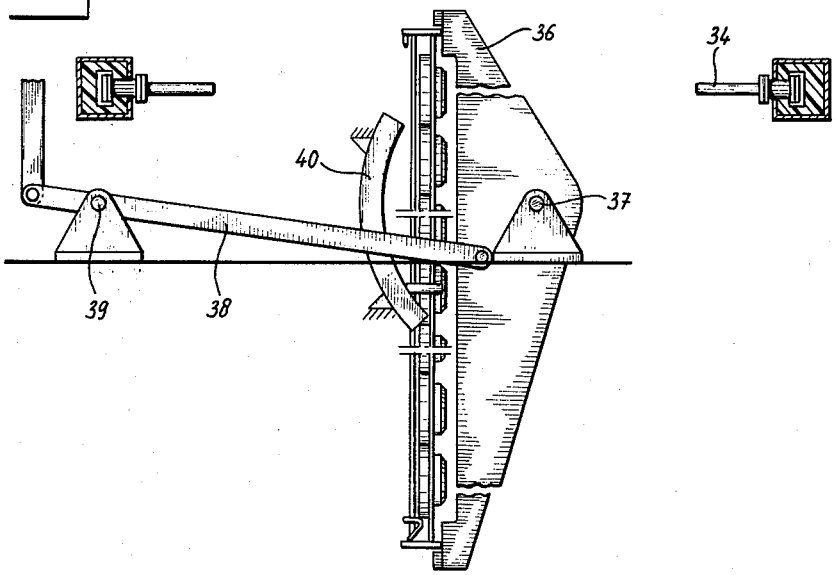
FIG. 12 is a view of a means according to FIG. 11 showing a casket in vertical position.

FIG. 10 is a view of the casket which is transported by means of two carrying chains provided with carrying pins 24. According to this embodiment the casket is pushed over leading strips 35. At the place of the means according to FIG. 11 the leading strip is interrupted and a movable lever 36 is present hinged around pin 37. In this lever 36 do fit the coupling plates 5 and 6 of the casket. By means of a lever system hinged around pin 37 the casket can be brought in vertical position. For preventing that the casket will fall off lever 36 a circular leading strip 40 is present, which will support plate 12 of the casket.

On account of the fully mechanical transport between the cleansing station and the capping station no intervention of physical labour is required between those stations so that the possibility for infections is reduced substantially.

I claim:

1. Machine for the treatment of head-shaped closures especially rubber closures fit for vials for containment of infusion or injection liquids provided with at least a means holding said closures during the cleansing stage and with nozzles in such positions that the cleansing liquid may be sprayed under several angles towards the closures characterized in that the means holdig the closures comprises one or more caskets having a number of parallel bars which are connected at both ends to each other by coupling plates whereby the parallel bars are arranged in such a way that the closures may find a place there between in the form of a row of a previously defined number and thereby held in such a way that the closures cannot be moved out of the space between the bars but do have such a tolerance that the cleansing liquid can reach any side of the closures whereby at least one of the coupling plates has an opening for passing the closures and the other coupling plate may form an eventual temporary barrier for the closures whereas a carrying means may lead the caskets filled with closures along nozzles spraying cleansing liquid.

2. Machine according to claim 1, characterized in that each of the caskets comprises three bars not lying in one plane.

3. Machine according to claims 1 or 2 characterized in that the carrying means comprises a carrying chain provided at regular distances with a number of links having a supporting means which may take one of the coupling plates.

4. Machine according to claim 3, characterized in that the machine is provided with two carrying chains which move synchronous with each other at such a distance that between said chains caskets may be placed on the supporting means fixed to the links.

5. Machine according to claims 3 or 4, characterized in that the links are provided with a tray wherein the coupling plate of the caskets fits.

6. Machine according to any one of the claims 3–5 characterized in that each of the carrying chains is led through a channellike rail provided with such a groove that one row of the links moves through the rail whereas the other row of links moves outside the rail.

7. Machine according to claim 6 characterized in that the rail at the inner side is filled up with a synthetic material which has a low frictional resistance with respect to the chain whereby a groove is made in the synthetic material having such a profile that the chain may glide therealong and is held also in position thereby.

8. Machine according to any one of the claims 4–7 characterized in that an intermittent moving vertical star-shaped disk is present between the carrying chains which disk in cooperation with leading grooves for the coupling plates may lift off the caskets from the trays fixed to the chains and put them into a vertical position so that the caskets may take up and release closures.

9. Machine according to claim 8 characterized in that at a release station for the closures the star-shaped disk cooperates with a horizontal disk (nest disk) which is provided with recesses along the periphery thereof wherein the coupling plates of the caskets fit which disk may transfer the caskets to a transport strip which passes under the nest disk for which the caskets at the then upper coupling plate are provided with a cam with which the casket may be held by the transport strip which transport strip brings the caskets to a second nest disk which brings the caskets to a station for the release of the closures in which station a means is present for pulling aside the closing cam or spring present in the then lower coupling plate of the casket so that the closures may leave the caskets and will be led further to a capping machine after which the second nest disk puts the casket back on the transport strip for taking over by the first nest disk which puts the caskets on the vertical star-shaped disk which puts the casket back on the carrying chain.

10. Machine according to claims 1, 2, 3, 4, 6 or 7 characterized in that the links of the carrying chains are provided with carrying pins whereas the caskets are supported by leading strips.

11. Machine according to claim 10 characterized in that a lever mechanism is used that may bring the casket into a vertical position whereby the lever mechanism interrupts the leading strips for the caskets.

12. Machine according to claims 10 or 11 characterized in that at a release station for the closures the lever cooperates with a horizontal disk (nest disk) which is provided with recesses along the periphery thereof wherein the coupling plates of the caskets fit, which disk may transfer the casket to a transport strip which passes under the nest disk for which the caskets at the then upper coupling plate are provided with a cam with which the casket may be held by the transport strip which transport strip brings the caskets to a second nest disk which brings the caskets to a station for the release of the closures in which station a means is present for pulling aside the closing cam or spring present in the then lower coupling plate of the caskets so that the closures may leave the caskets and will be led further to a capping machine after which the second nest disk puts the casket back on the transport strip for taking over by the first nest disk which puts the caskets on the lever which puts the caskets back on the carrying chain.

13. Machine according to any one of the preceding claims characterized in that the carrying means and the caskets carried therewith do pass at least one more station for instance a drying station.

* * * * *